US008953829B2

(12) United States Patent
Mehlsen et al.

(10) Patent No.: US 8,953,829 B2
(45) Date of Patent: Feb. 10, 2015

(54) BEHIND THE EAR HEARING AID WITH RECEIVER IN THE EAR

(75) Inventors: Maria Mehlsen, Copenhagen (DK); Mads Grønlund Andersen, Copenhagen (DK); Klaus Sommer Ipsen, Smørum (DK); Bo Skjoldborg, Smørum (DK); Niels Stubager Kiemer, Smørum (DK); Morten Philip, Smørum (DK); Jan T. L. Larsen, Smørum (DK); Michael Frydendal, Veksø (DK); Peter Spragge, Smørum (DK)

(73) Assignee: Oticon A/S, Smorum (DK)

( * ) Notice: Subject to any disclaimer, the term of this patent is extended or adjusted under 35 U.S.C. 154(b) by 220 days.

(21) Appl. No.: 13/464,511

(22) Filed: May 4, 2012

(65) Prior Publication Data

US 2012/0281864 A1 Nov. 8, 2012

Related U.S. Application Data

(60) Provisional application No. 61/483,077, filed on May 6, 2011.

(30) Foreign Application Priority Data

May 6, 2011 (EP) ..... 11165104

(51) Int. Cl.
*H04R 25/00* (2006.01)

(52) U.S. Cl.
CPC ..... *H04R 25/60* (2013.01); *H04R 2225/021* (2013.01); *H04R 2225/63* (2013.01)
USPC ..... 381/330; 381/322; 381/324

(58) Field of Classification Search
CPC ..... H04R 25/02; H04R 25/60; H04R 25/65; H04R 25/652; H04R 2225/021; H04R 2225/023; H04R 2225/025; H04R 2225/63
USPC ..... 381/332, 324, 328, 330; 181/130, 135
See application file for complete search history.

(56) References Cited

U.S. PATENT DOCUMENTS

| | | | | |
|---|---|---|---|---|
| 3,123,678 | A * | 3/1964 | Prentiss et al. | 381/322 |
| 5,708,720 | A * | 1/1998 | Meyer | 381/322 |
| 7,286,678 | B1 | 10/2007 | Bächler et al. | |
| 2008/0116284 | A1 | 5/2008 | Gordon | |
| 2009/0074218 | A1 * | 3/2009 | Higgins | 381/323 |
| 2009/0180653 | A1 * | 7/2009 | Sjursen et al. | 381/322 |
| 2010/0067725 | A1 | 3/2010 | Schumaier et al. | |
| 2011/0019849 | A1 * | 1/2011 | Nielsen | 381/322 |
| 2012/0063621 | A1 * | 3/2012 | Naumann | 381/323 |

FOREIGN PATENT DOCUMENTS

| | | | |
|---|---|---|---|
| DE | 10 2007 009 748 | A1 | 9/2008 |
| EP | 2 160 047 | A2 | 3/2010 |
| GB | 982259 | | 2/1965 |
| WO | WO 2009/087241 | A2 | 7/2009 |
| WO | WO 2010/034353 | A1 | 4/2010 |
| WO | WO 2011/098153 | A1 | 8/2011 |

* cited by examiner

*Primary Examiner* — Jesse Elbin
(74) *Attorney, Agent, or Firm* — Birch, Stewart, Kolasch & Birch, LLP

(57) ABSTRACT

A behind the ear hearing aid is provided with a casing part comprising electronics adapted for signal processing where the casing is adapted for placing behind the ear of a user and a speaker is provided in or near the ear canal and leads are arranged between the speaker and the casing part. A plug and socket electrical and mechanical interconnection is arranged between the leads and the electronics inside the casing and the mutual motion between the plug and socket parts for establishing connection is in a direction essentially off axis to the axis of the leads at the casing part.

7 Claims, 13 Drawing Sheets

BEHIND THE EAR HEARING AID WITH RECEIVER IN THE EAR

CROSS REFERENCE TO RELATED APPLICATIONS

This nonprovisional application claims the benefit of U.S. Provisional Application No. 61/483,077 filed on May 6, 2011 and to Patent Application No. 11165104.8 filed in Europe, on May 6, 2011. The entire contents of all of the above applications is hereby incorporated by reference.

AREA OF THE INVENTION

This invention relates to a behind the ear hearing aid with a casing part adapted for placing behind the ear of a user and a speaker provided in or near the ear canal and a lead connection between the speaker and the casing part.

BACKGROUND OF THE INVENTION

In hearing aids of this kind, there are a number of challenges in making a reliable and easy to operate electro-mechanical construction. The in the ear piece is difficult for the user to place correctly in the ear, and the electric and mechanical connection of the lead with the behind the ear casing part also constitutes a vulnerable element as leads must be exchangeable in order that the user may have a lead with length and shape according to the individual physiognomy and head shape. Further, it may be difficult for some users to determine whether the apparatus in hand is to fit the right side or the left side ear.

SUMMARY OF THE INVENTION

As used herein, the singular forms "a," "an," and "the" are intended to include the plural forms as well (i.e. to have the meaning of "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements maybe present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

In an embodiment of the invention a behind the ear hearing aid is provided with a casing part comprising electronics adapted for signal processing where the casing is adapted for placing behind the ear of a user and a speaker is provided in or near the ear canal and leads are arranged between the speaker and the casing part. A plug and socket electrical and mechanical interconnection is arranged between the leads and the electronics inside the casing and the mutual motion between the plug and socket parts for establishing connection is in a direction essentially off axis with respect to the axis of the leads at the casing part. In this way pulling at the lead cannot cause dis-connection between the plug and socket parts, and a locking mechanism for fastening the plug in the socket is not needed.

The casing part may comprise two shell elements adapted to be interconnected in order to enclose the electronics. The motion between the plug and socket parts in order to un-plug the plug is by this construction enabled only when the two shell elements are disconnected. This further enhances the security of the interconnection between the in the ear and the behind the ear parts of the hearing aid.

The first shell element is possibly a u-shaped shell adapted to be seated with up-turned legs in the u-shaped intersection between ear and head of the user, and the second shell element is a flat lid element adapted to close off the space between the two legs. The lead may pass into the space defined between the first and the second shell element in the parting line between the two shell elements. As the plug in this way is trapped between the two shell elements, it becomes even more difficult to inadvertently pull the plug and lead away from the housing.

The two shell elements may be coupled to each other at first and second spaced apart connection areas such that the first connection area is provided at the entry point of the lead into the casing. To have at least one connection point at the entry point of the lead may aid to ensure, that in-advertent pull on the lead should cause the two shell elements to come apart and release the plug out of the socket.

The first connection area may comprise releasable interlocking engagement elements between the two shell parts. An interlocking engagement between the shell element ensures that they will remain locked together.

The second connection area may comprise a frictional and/or flexible latch type of connection between the two shell elements. In this way the second connection area may be considerably easier to disconnect, so the lid part will easy come away from the u-shaped shell element in this area.

The interlocking engagement elements between the two shell parts may comprise an undercut section in one of the two shell parts, and a protrusion in the opposed shell part which fits the undercut section. In this way a sliding or rotational movement between the two shell parts may cause the protrusion to enter into the undercut section.

BRIEF DESCRIPTION OF THE DRAWINGS

The figures are schematic and simplified for clarity, and they just show details which are essential to the understanding of the invention, while other details are left out. Throughout, the same reference numerals are used for identical or corresponding parts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF A PREFERRED EMBODIMENT

Figure 1:
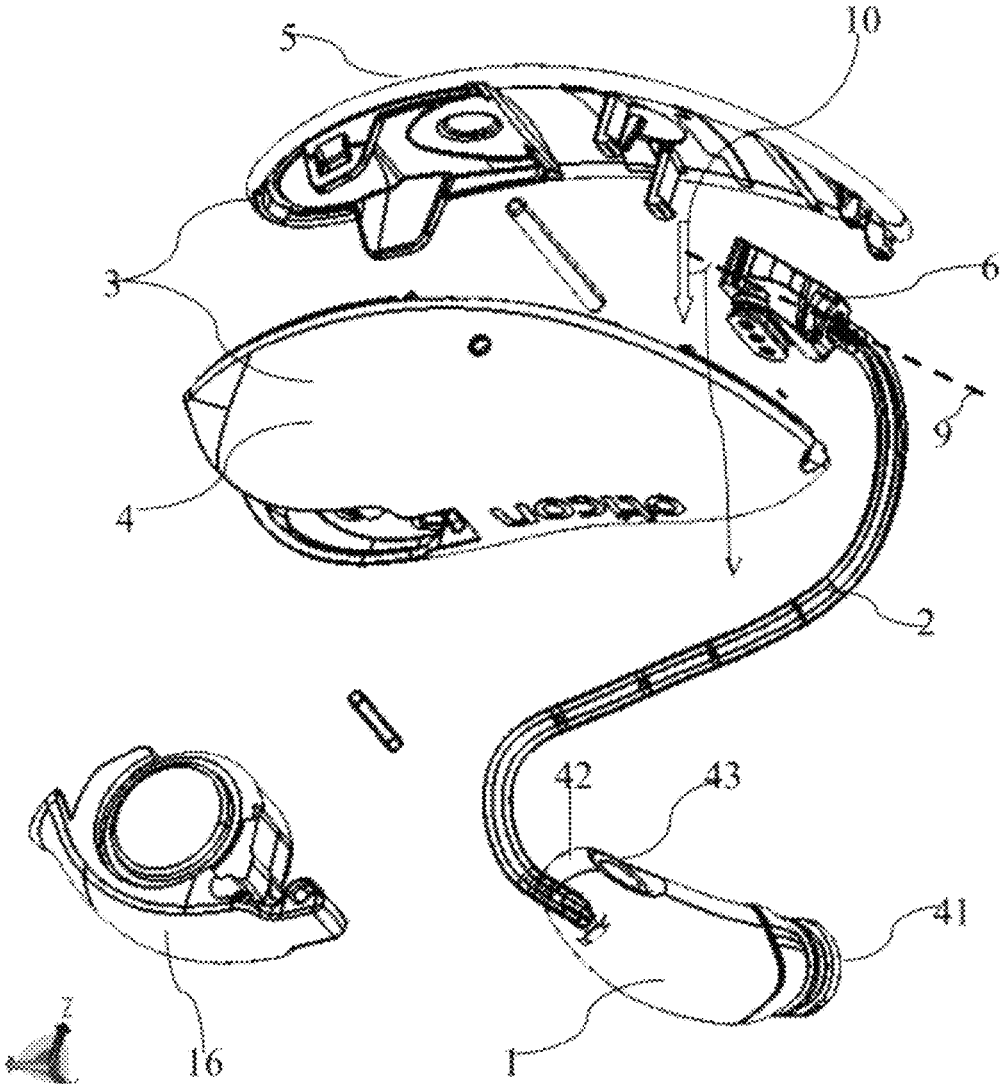
FIG. 1 is an exploded view showing a hearing aid in a 3d projection.

FIG. 1 shows an exploded view of the hearing aid with the in the ear part 1, the lead 2 and the casing 3 to be seated above and/or behind the users ear (not shown) in the area of intersection between ear and head. To this end the casing comprises a u-shaped lower shell part 4, which fits well into this area. A further part of the shell is made as a lid 5, which spans the legs of the u-shaped lower shell part.

A plug 6 and socket 7 is provided at the foremost part of the shell where the plug is attached to the lead 2 and the socket is part of the electronics module 11 inside the shell elements 3. In order to plug the lead 2 with the plug 6 into the electronics module inside the shell 3, the plug is to move downwards (indicated by arrow 10 in FIG. 1), that is in a direction essentially off axis with respect to the direction indicated by the lead 2 (indicated by dashed line 9 in FIG. 1) at the connector plug 6. By this arrangement of the plug and socket connector, it is ensured, that pull at the lead 2 in its length direction cannot pull the plug 6 out of the socket 7.

As further seen in FIG. 1, there is an acute angle v between the lead direction 9 and the direction of insertion 10, and thereby a pulling force at the lead 2 essentially along the line 9 will translate into a force component directed in the direction of the arrow 10 and no component can exist in the direction opposed to the direction of the arrow 10. Thereby a pulling force at the lead 2 may bring the plug 6 further into the socket 7 and not out of the socket 7.

Figure 4:
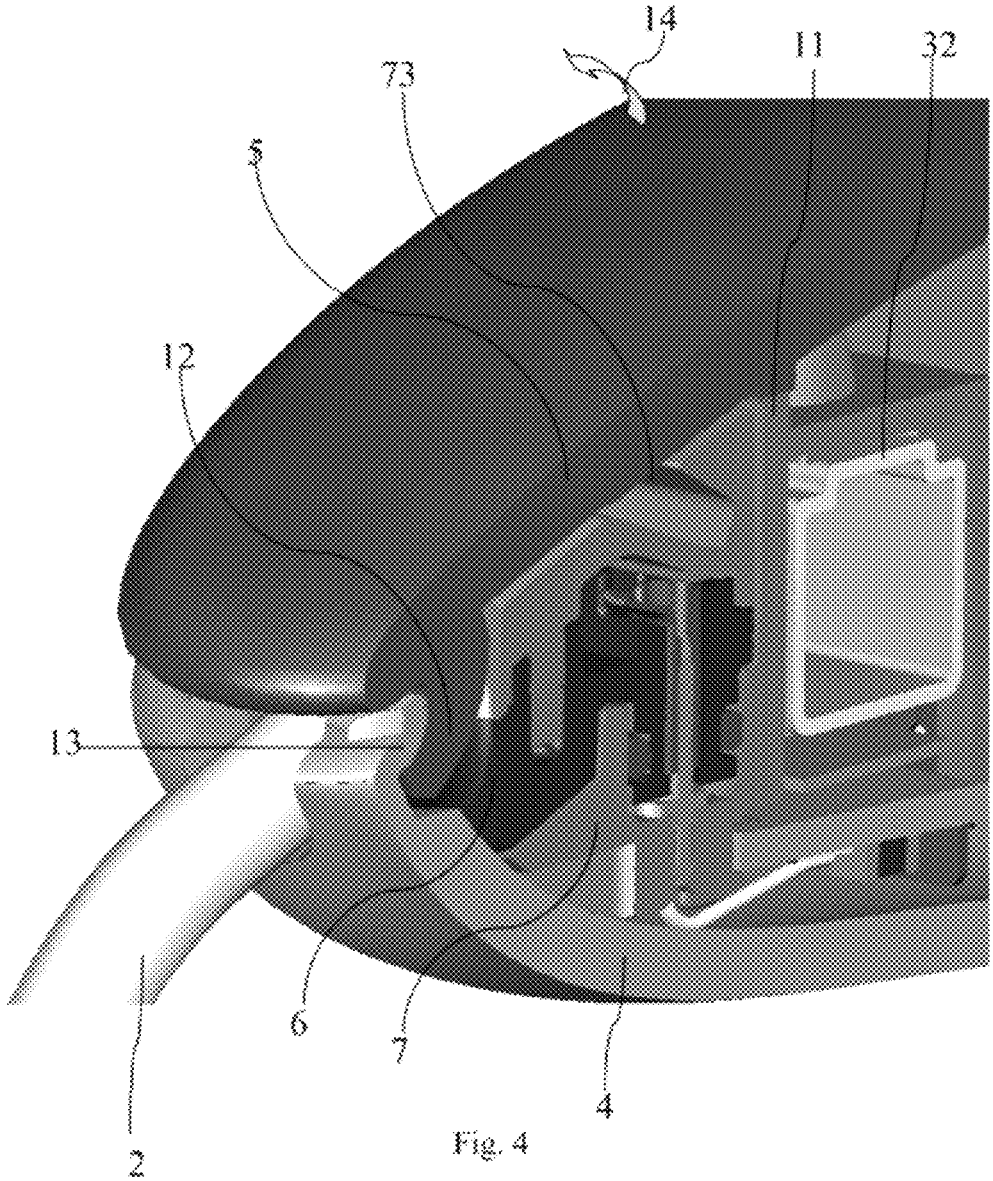
FIGS. 4 and 4*a* shows a sectional view of the hearing aid.
Figure 4A:
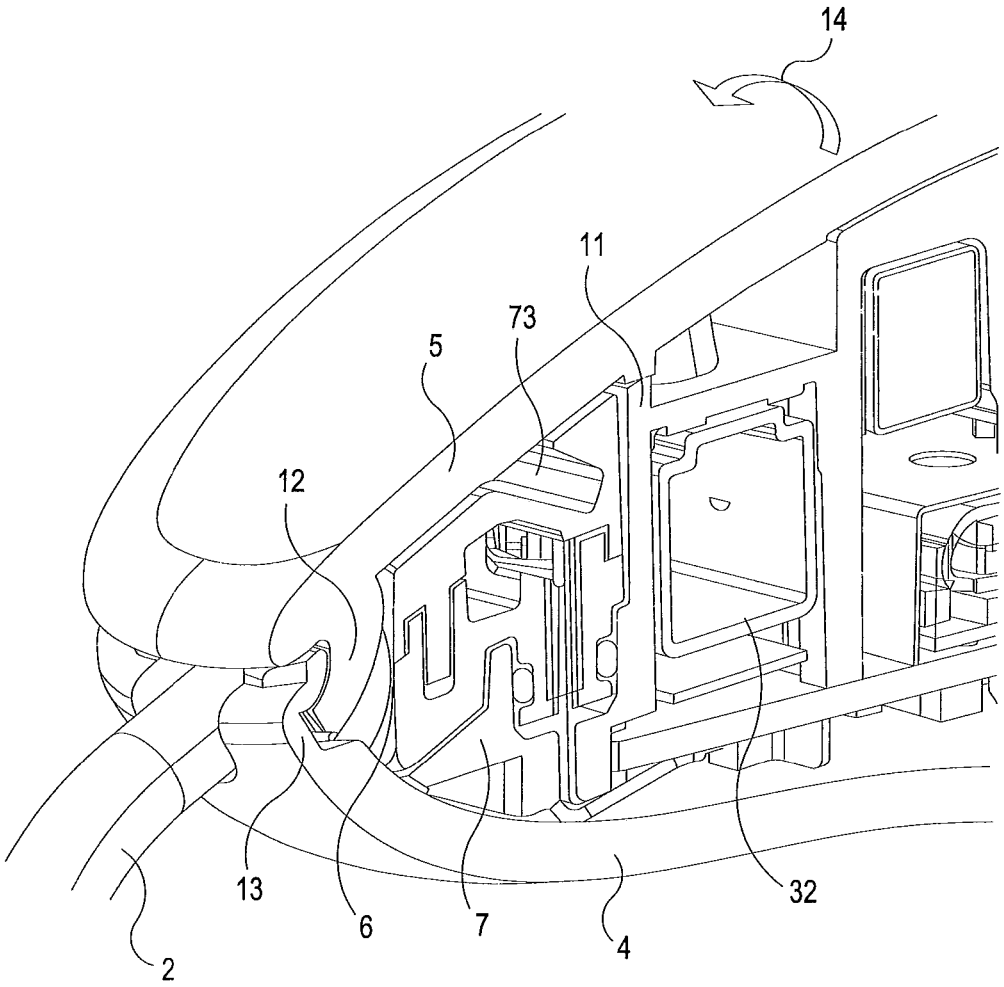
Figure 5:
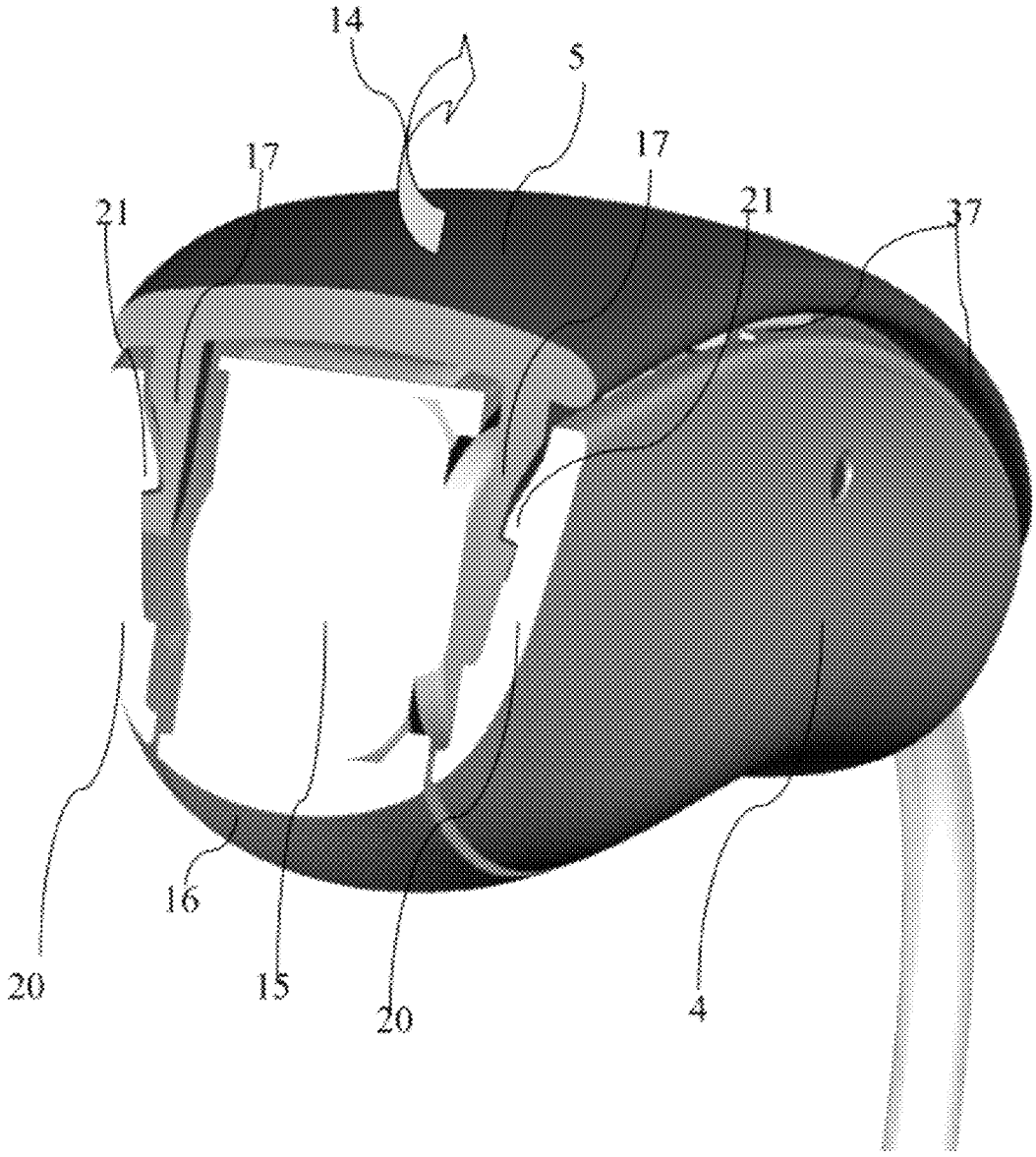
FIGS. 5 and 5*a* shows a sectional view of the backend of the hearing aid.
Figure 5A:
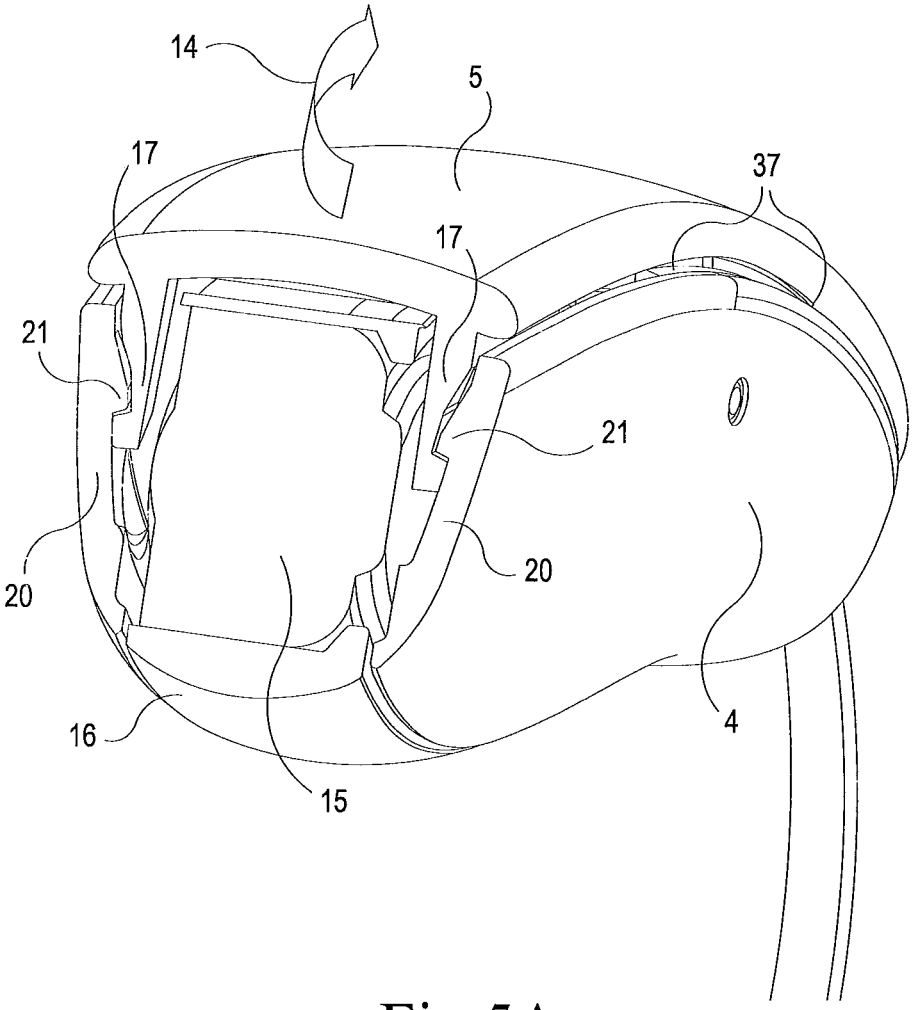

In FIGS. 4 and 4*a* a sectional view is shown of the foremost part of the hearing aid. The plug 6 is shown plugged into the socket 7 of the electronics module 11, and the lead 2 protrudes out between the U-shaped shell part 4 and the lid part 5. The lid part 5 of the shell has a protrusion 12, which fits into an undercut 13 of the U-shaped shell 4, whereby a pivotal movement of the lid part 5 with respect to the U-shaped shell part 4 will bring the protrusion 12 into and out of engagement with the undercut 13. Once the protrusion 12 is seated in the undercut 13, the lid 5 cannot be moved away from the shell 4 unless the lid is pivoted upwards as indicated by arrow 14. This pivotal movement is facilitated by the further connection area between the lid element 5 and the U-shaped shell part 4, which are provided spaced apart from the protrusion 12 and undercut connection elements 13, and placed at a back end part of the hearing aid. This is shown in FIGS. 5 and 5*a*. In FIGS. 5 and 5*a* arrow 14 indicates the direction of movement of the lid element 5 with respect to the U-shaped casing element 4, which should be initiated to remove the lid 5 from the U-shaped element 4.

The sectional view of FIGS. 5 and 5*a* shows the battery 15 and battery drawer 16, and at each their side of the battery 15 downwardly directed latches 17. The latches 17 are made to move flexibly towards each other when the lid 5 is pressed down forcing the lathes 17 into the space between the two legs 20 of the U-shaped shell element 4, and at the end of this movement the latches 17 are to form releasable engagement with recesses 21 provided in the sidewalls or legs 20 of u-shaped casing element 4. The lid element 5 is best released in this manner when the battery drawer 16 is fully opened. Further such latch/recess pairs may be provided along the length of the hearing aid.

Figure 2:
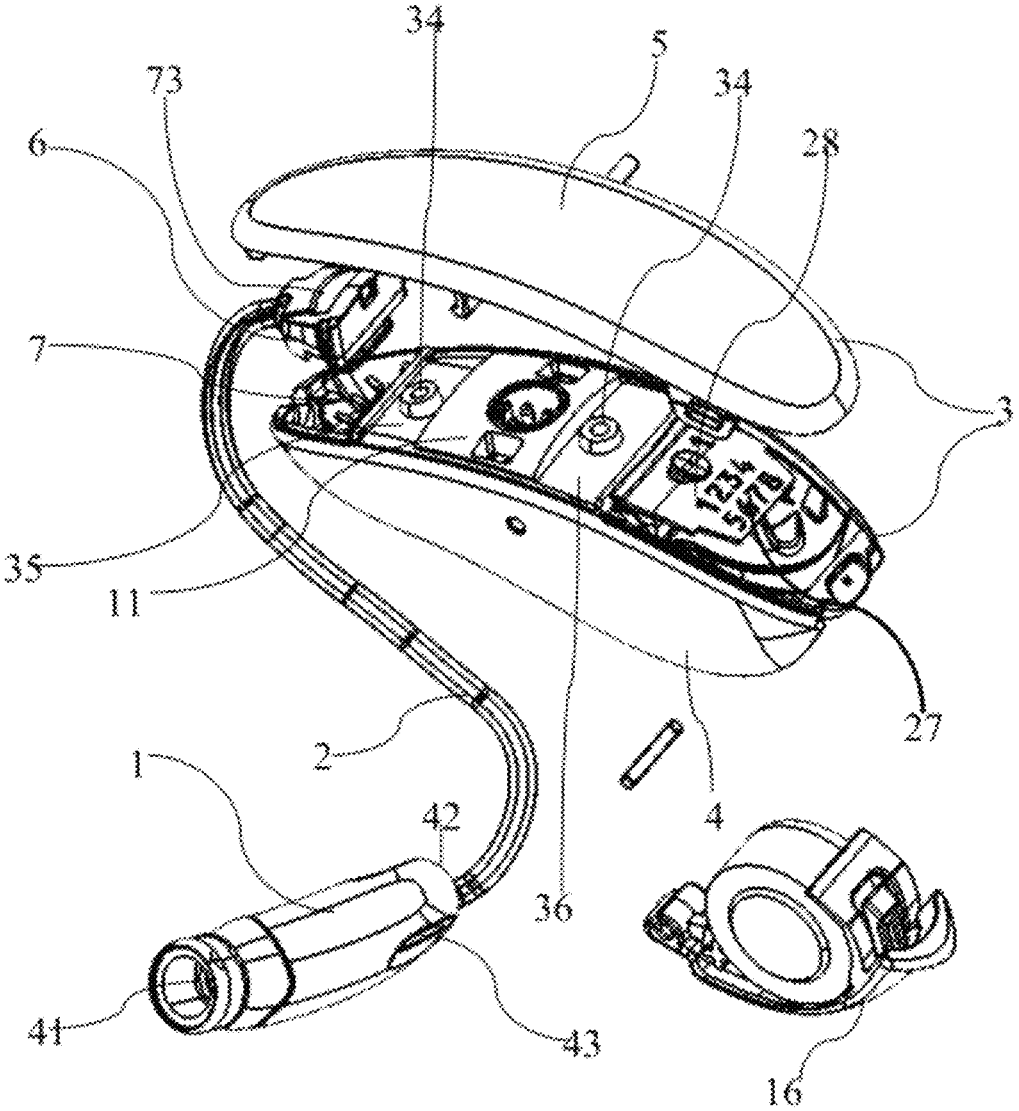
FIG. 2 is an exploded view, but from a different angle.
Figure 6:
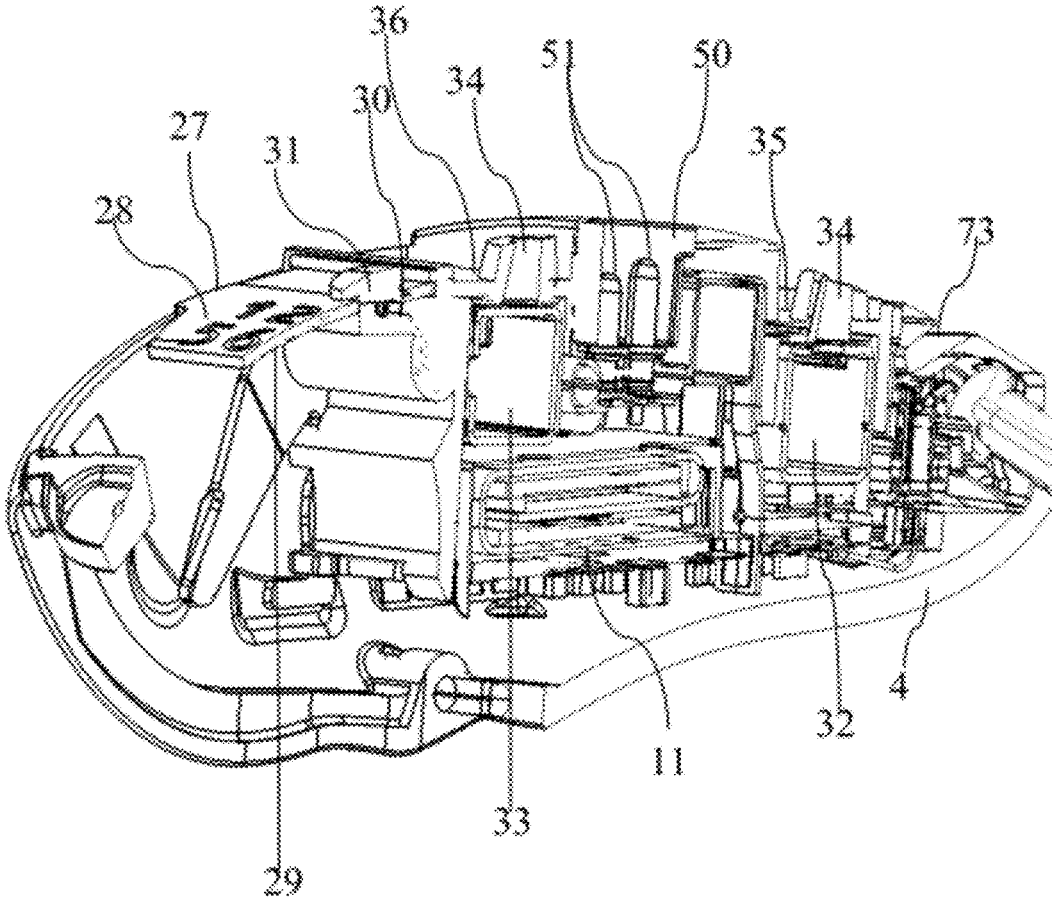
FIGS. 6 and 6*a* shows a sectional view of the hearing aid with the upper lid element not displayed.
Figure 6A:
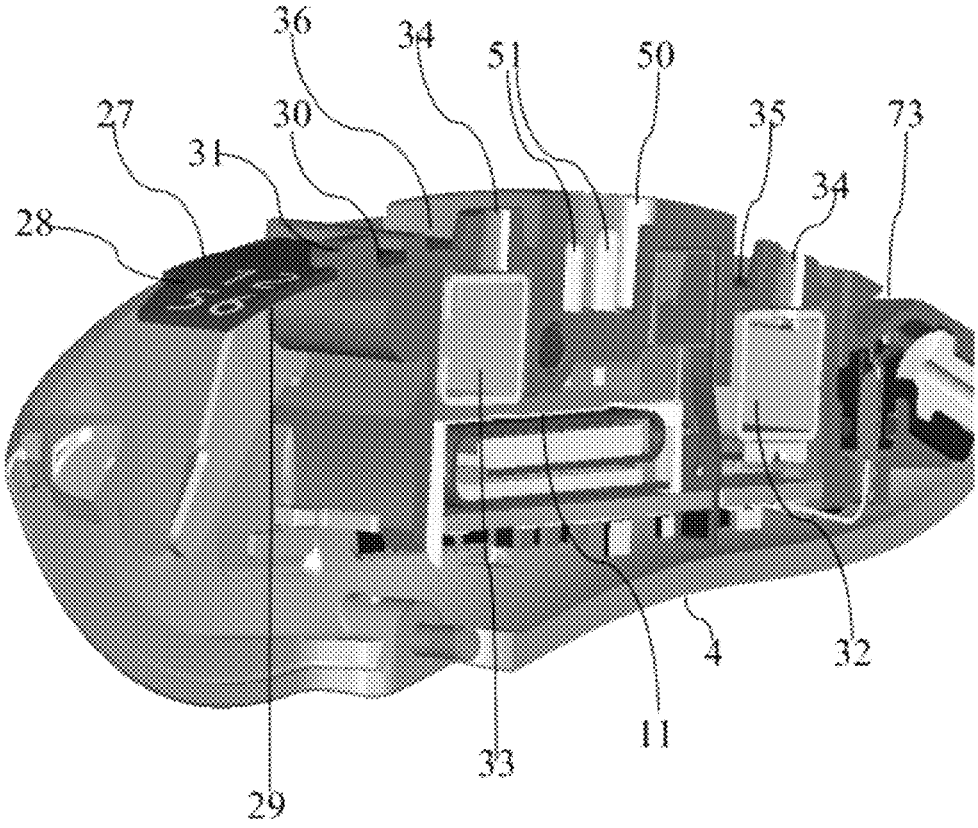

Attached to the electronics module 11 a number plate 27 is visible in FIG. 2 and FIGS. 6 and 6*a*. In FIG. 6 the hearing aid is shown in sectional 3D projection but without the lid element and the battery drawer displayed. When the lid element 5 is taken off, the upper side 28 of the number plate 27 is visible from above, and when the battery door is opened fully up the underside 29 of the number plate 27 is visible from below. Thereby a large display area for information is provided by the number plate arrangement, where the plate is attached to the electronics module 11 by way of a through-hole 30 provided at an edge part of the number plate 27. The electronics module comprises a protruding holder element 31, to which the number plate 27 is attached by through hole 30.

Figure 3:
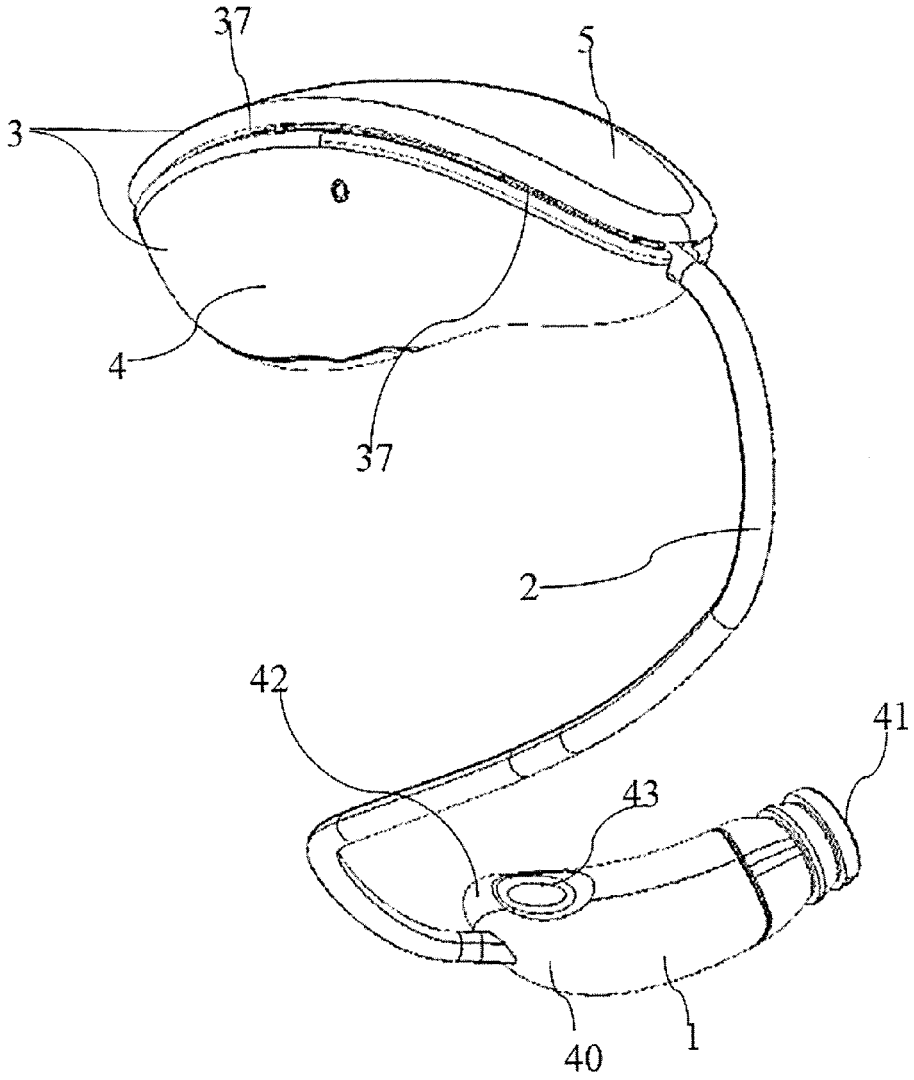
FIG. 3 is a projectional view of the hearing aid with the in the ear part 1.

The receiver element 1 is seen in FIG. 3, and comprises a casing element 40, and shaped slightly curved from the back end to the front end with the sound exit opening 41, such that the receiver element may better be accommodated in the curved part of the ear canal. At the back end, the casing 40 is connected to the lead 2 and also at this part of the casing element 40 a projecting nose 42 is provided next to connection point between lead 2 and casing element 40. The user may exert pressure onto the projecting nose 42 when the receiver element 1 is to be inserted into the ear.

The projection nose 42 comprises a through hole 43 in which a strip (not shown) of flexible plastics may be mounted. Such a strip may aid in keeping the speaker unit 1 in place in the ear canal. When no such strip is needed, a small plug (not shown) may be inserted into the hole 43, and this plug may preferably comprise a colour marking indicative of the side of the users head to which the hearing aid is suited.

The electronics module comprises a front microphone 32 and a back-end microphone 33. Both microphones are coupled through sound inlet ducts 34 to an open area 35, 36 below the lid element 5, this open space then being open to the surrounding environment though slits 37 provided between the lid element 5 and the U-shaped casing element 4. Air flows in the open areas 34, 35 will be very limited due to the small size of the slit 36, 37, thus very little wind noise is generated around the sound ducts 32, 33. The inlet structure is shown in a 3D projection in FIG. 7. As seen the slit 37 leads from the exterior and into extended volumes 35, 36 which are shielded from the surroundings, and from these volumes access is granted to the ducts 34 leading into the microphone enclosure. The extended size of the slits 37 will help in ensuring that turbulence noise is kept at a minimum here.

Figure 7:
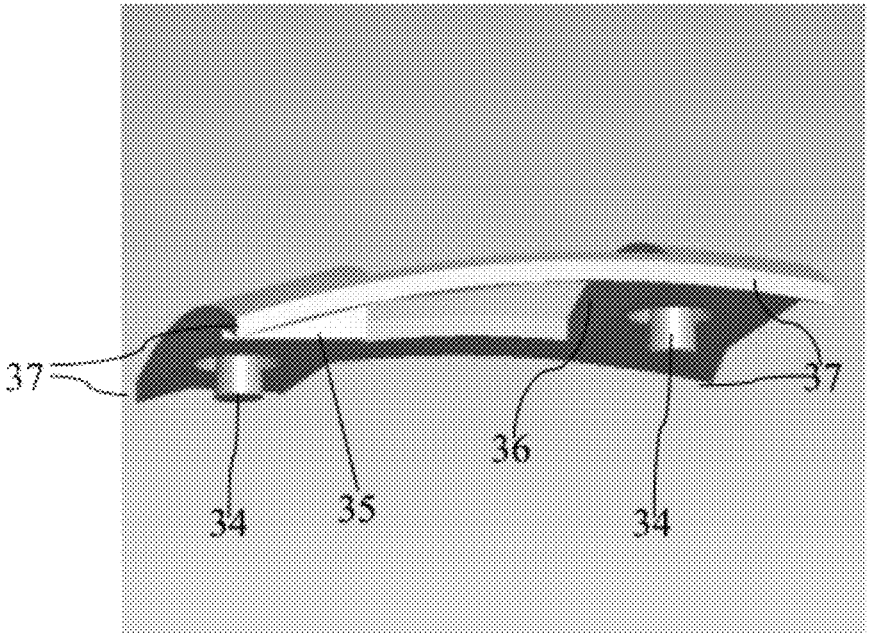
FIG. 7 is the inlet air way to from the outside and into the microphone shown in a 3d projection
Figure 8:
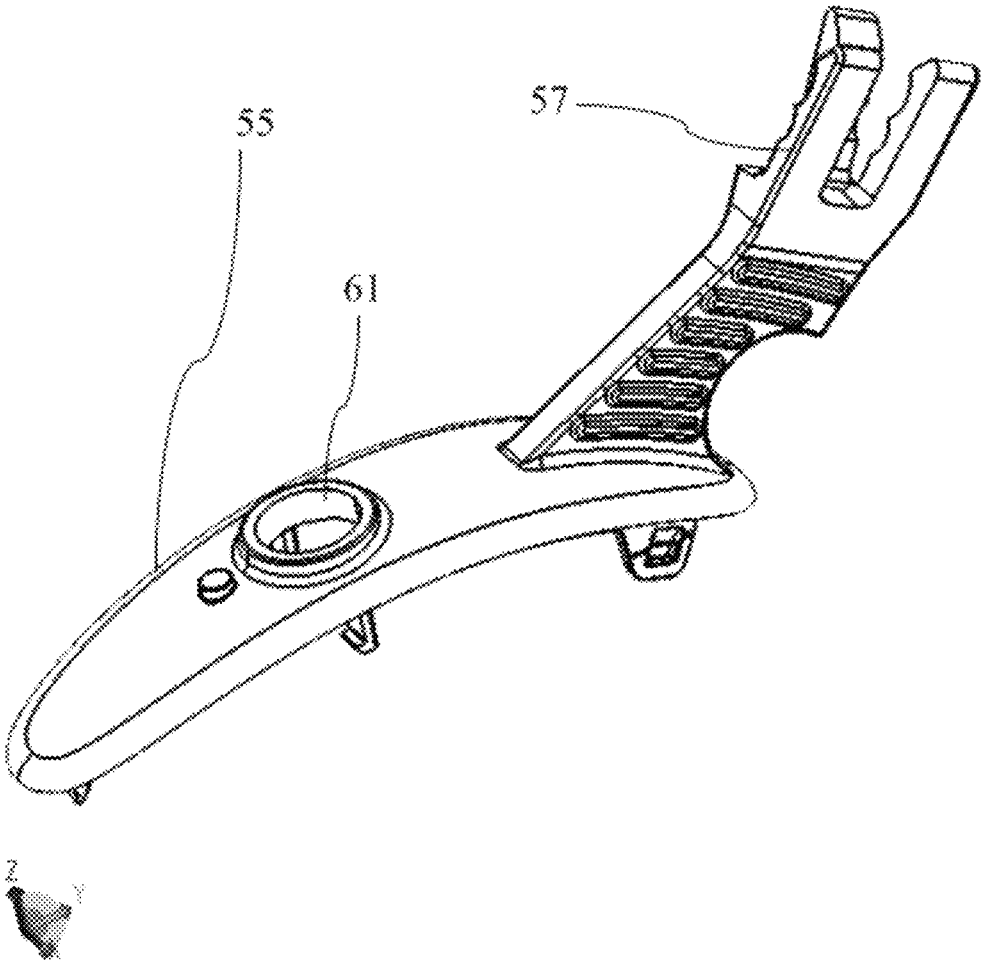
FIG. 8 shows an adapter used for programming the hearing aid.
Figure 9:
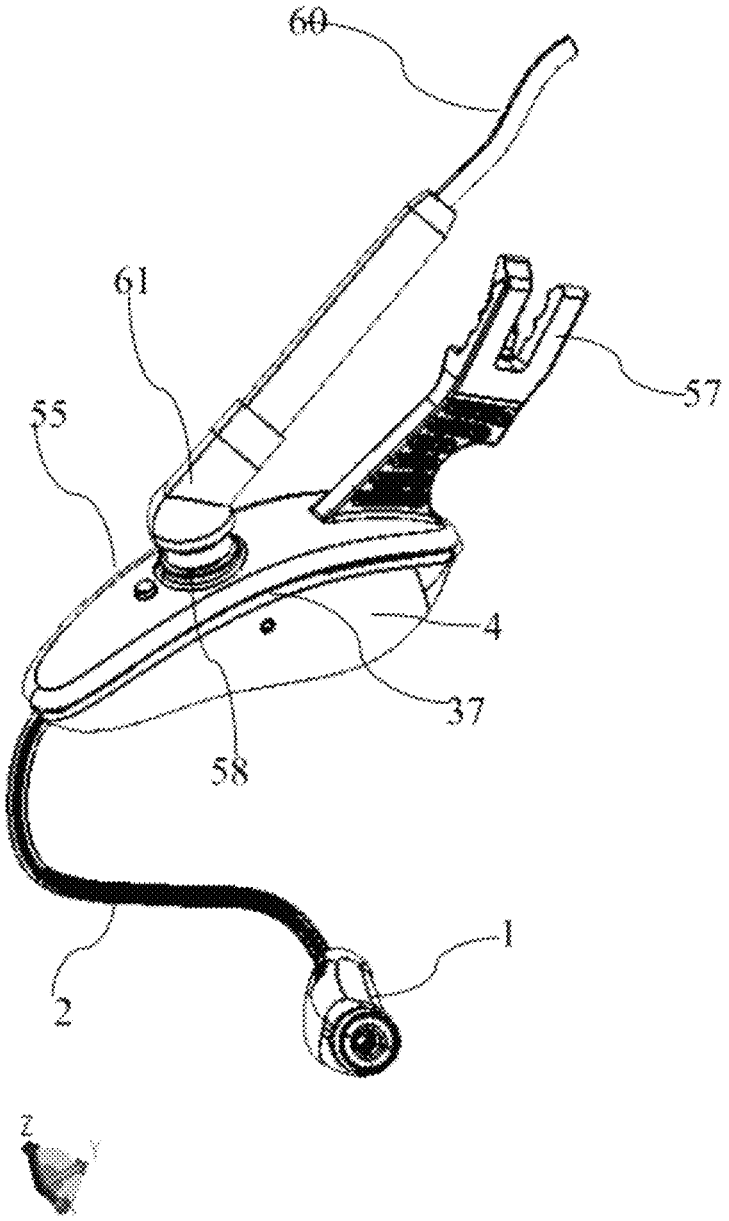
FIG. 9 shows the hearing aid with the adapter and the hearing aid with programming cable.

The electronics module 11 comprises a programming socket 50 with programming pins 51 such that a programming cable 60 may be connected to the hearing aid. This is seen in FIG. 6. The programming socket 50 is thus only visible and available for contacting when the lid element 5 is removed. However, the lid element 5 must be in place in order for the proper functioning of the microphones 33,32 such that the inlet structure between the lid 5 and the hearing aid is established. Certain types of measurements are performed using the microphones during programming such as determination of feedback margin which cannot then be performed without the lid 5. To this end a special programming adapter 55 is provided as seen in FIG. 8. In FIG. 9 the adapter 55 is seen in use, and attached to the hearing aid and with the programming plug 61 coupled to the socket 50 in the hearing aid through a central hole 58 in the adapter 55. The adapter 55 mimics the shape of the lid element 5, such that the inlet structure shown in FIG. 7 is established between the adapter 50 and the hearing aid, and further the outer shape of the hearing aid around the inlet opening to the microphone is also re-established with the adapter 50. Thereby it is ensured that the microphones will have exactly the same acoustic properties with the programming cable coupled to the hearing aid as without the cable and with the lid element 5 in place. Further this arrangement allows the wired programming to be performed without making a further dedicated lid element to hide and protect the socket as is otherwise the usual practise.

As seen in FIG. 9 the adapter comprise a cable holder 57, whereto the programming cable 60 may be coupled such that it is maintained in a position away from the microphone opening slits 37. The hearing care professional who is to program the hearing aid will start the procedure by removing the lid 5 and attaching the adapter 55 to the hearing aid in its place. Then the programming plug is inserted into the programming socket 50 and the programming cable is mounted onto the cable holder 57. Now the hearing aid with the programming cable may be seated on the ear with the in the ear part 1 being inserted into the ear of the user.

Figure 10:
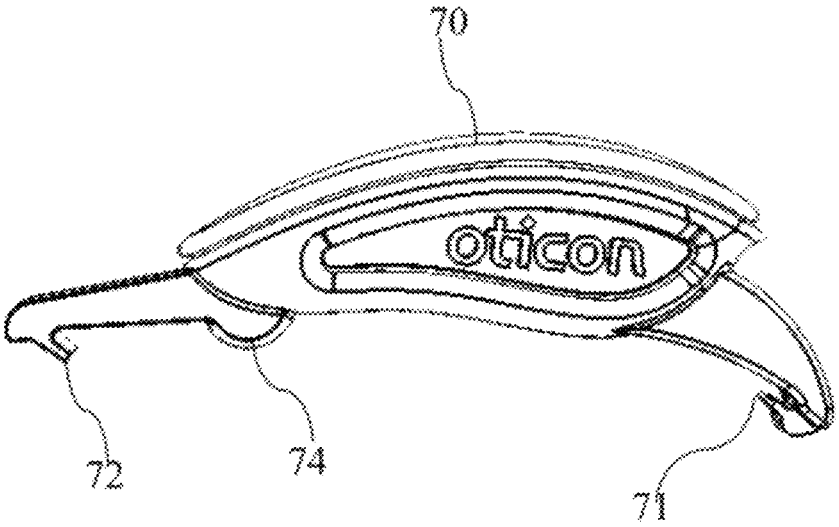
FIG. 10 is a plane view of a service tool.

FIG. 10 shows a side view of a service tool 70. At the one end thereof a hook 71 is provided, which may be used to prey open the lid 5 in the direction of the arrow 14. In use firstly the battery drawer is opened, and then the hook 71 is placed under the edge of the lid 5 and using only light force on the tool 70 the lid is moved in the direction of the arrow 14. In the opposed end an angled blade part 72 is provided, which fits into a recess 73 provided in the plug 6. With the blade part 72 inserted into the recess 73, the tool is pressed down, in order that the abutment 74 is pressed towards the electronics module 11, and by further pressing down on the opposed end of the service tool a lever lifting force will be transmitted to the plug 6. In this way the plug is lifted out of the apparatus without straining the lead 2 or any other part of the construction.

The invention claimed is:

1. A behind the ear hearing aid, comprising:

a casing part containing electronics adapted for signal processing, wherein the casing part is adapted for placing behind the ear of a user, a speaker is provided in or near the ear canal, leads are arranged between the speaker and the casing part, a plug and socket electrical and mechanical interconnection is arranged between the leads and the electronics inside the casing part to create an acute angle between a lead direction and a direction of insertion whereby mutual motion of the plug with respect to socket parts for establishing connection is in a direction essentially off axis to the axis of the leads at the casing part.

2. Behind the ear hearing aid as claimed in claim 1, wherein the casing part comprises two shell elements adapted to be interconnected in order to enclose the electronics and wherein the motion between the plug and the socket parts in order to un-plug the plug is enabled only when the two shell elements are disconnected.

3. Behind the ear hearing aid as claimed in claim 2, wherein the first shell element is a u-shaped shell adapted to be seated with up-turned legs in a u-shaped intersection between ear and head of a user of the behind the ear hearing aid, and the second shell element is a flat lid element adapted to close off the space between the up-turned legs, whereby the lead passes into a space defined between the first and the second shell element in a parting line between the two shell elements.

4. Behind the ear hearing aid as claimed in claim 3, wherein the two shell elements are coupled to each other at first and second spaced apart connection areas, wherein the first connection area is provided at the entry point of the lead into the casing.

5. Behind the ear hearing aid as claimed in claim 4, wherein the first connection area comprises releasable interlocking engagement elements between the two shell elements.

6. Behind the ear hearing aid as claimed in claim 5, wherein the second connection area comprises a frictional and/or flexible latch type of connection between the two shell elements.

7. Behind the ear hearing aid as claimed in claim 5, wherein the interlocking engagement elements between the two shell elements comprise an undercut section in one of the two shell elements, and a protrusion in the opposed shell element which fits the undercut section, such that a sliding or rotational movement between the two shell parts causes the protrusion to enter into the undercut section.

* * * * *